US009956769B2

(12) United States Patent
Makinose et al.

(10) Patent No.: US 9,956,769 B2
(45) Date of Patent: May 1, 2018

(54) LIQUID INJECTION DEVICE AND INKJET PRINTER INCLUDING THE SAME

(71) Applicant: Roland DG Corporation, Hamamatsu-shi, Shizuoka (JP)

(72) Inventors: Takashi Makinose, Hamamatsu (JP); Keisuke Misawa, Hamamatsu (JP); Kenji Kawagoe, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days. days.

(21) Appl. No.: 15/585,239

(22) Filed: May 3, 2017

(65) Prior Publication Data

US 2017/0320321 A1 Nov. 9, 2017

(30) Foreign Application Priority Data

May 9, 2016 (JP) ..... 2016-093747

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/2121; B41J 2/2128; B41J 2/211; B41J 2/2054; B41J 2/205; B41J 2/0451; B41J 2/0457; B41J 2/04573; B41J 2/04581; B41J 2/04595; B41J 2/0459; B41J 2/04591
See application file for complete search history.

(56) References Cited

U.S. PATENT DOCUMENTS

2012/0300001 A1* 11/2012 Panchawagh ..... B41J 2/075 347/76
2013/0249983 A1* 9/2013 Marcus ..... B41J 2/085 347/10
2014/0009523 A1* 1/2014 Marcus ..... B41J 2/03 347/10

FOREIGN PATENT DOCUMENTS

JP 2007-062326 A 3/2007

* cited by examiner

*Primary Examiner* — Geoffrey Mruk
*Assistant Examiner* — Scott A Richmond
(74) *Attorney, Agent, or Firm* — Keating & Bennett, LLP

(57) ABSTRACT

A liquid injection device includes a driving circuit supplying, to an actuator, a driving signal including a prior driving pulse and a subsequent driving pulse supplied after the prior driving pulse. Where a speed of a leading tip of a prior liquid pillar injected from the nozzle by the prior driving pulse is V3, a speed of a leading tip of a subsequent liquid pillar injected from the nozzle by the subsequent driving pulse is V4, a time period from start of the injection of the prior liquid pillar until start of the injection of the subsequent liquid pillar is t4*a*, a difference between a time period from the injection of the prior liquid pillar from the nozzle until division of the prior liquid pillar in the case where the prior driving pulse is supplied to the actuator but the subsequent driving pulse is not supplied to the actuator, and the time period t4*a*, is t4*b*, and a time period from start of the injection of the prior liquid pillar until separation of the prior liquid pillar from the nozzle in the case where the prior driving pulse is supplied to the actuator but the subsequent driving pulse is not supplied to the actuator is t3*a*, t4*a*≤t3*a* and V4≥V3×(t4*a*/t4*b*+1) are satisfied.

10 Claims, 9 Drawing Sheets

LIQUID INJECTION DEVICE AND INKJET PRINTER INCLUDING THE SAME

CROSS REFERENCE TO RELATED APPLICATIONS

This application claims the benefit of priority to Japanese Patent Application No. 2016-093747 filed on May 9, 2016. The entire contents of this application are hereby incorporated herein by reference.

BACKGROUND OF THE INVENTION

1. Field of the Invention

The present invention relates to a liquid injection device and an inkjet printer including the same.

2. Description of the Related Art

Conventionally, a liquid injection device including a pressure chamber storing a liquid, a vibration plate defining a portion of the pressure chamber, an actuator coupled with the vibration plate, a nozzle in communication with the pressure chamber, and a driving circuit supplying a driving signal to the actuator to drive the actuator is known. Such a liquid injection device is provided in, for example, an inkjet printer injecting ink as the liquid.

In an inkjet printer including the liquid injection device, when the driving circuit supplies a driving pulse signal (hereinafter, referred to as a "driving pulse") to the actuator, the actuator is deformed. In accordance therewith, the vibration plate is deformed. As a result, the pressure chamber has a capacity thereof increased or decreased, and the pressure of the ink in the pressure chamber is changed. In accordance with the change in the pressure, the ink is injected from the nozzle. The injected ink becomes an ink drop and lands on a recording medium such as a recording paper sheet or the like. As a result, one dot is formed on the recording medium. A great number of such dots are formed on the recording medium, so that an image or the like is formed.

As long as the sizes of such dots are adjusted, a high-quality image is formed on the recording medium. However, with the inkjet printer as described above, there is a limit on the amount of ink that can be stably injected by one driving pulse. A technology of supplying a plurality of driving pulses to the actuator in a time period that is preset as a time period for forming one dot on a recording medium (hereinafter, such a time period will be referred to as a "driving cycle") is known (see, for example, Japanese Laid-Open Patent Publication No. 2007-62326). A plurality of driving pulses are supplied, and thus ink is injected from the nozzle a plurality of times. The plurality of drops of injected ink are combined in the air and then land on the recording medium, or the plurality of drops of injected ink land on the recording medium successively, and thus form one dot on the recording medium. Such a recording system is referred to as a "multi-drop system". According to the multi-drop system, a large drop that cannot be formed with one driving pulse is formed.

FIG. 9 shows a driving signal and a behavior of ink in an example of liquid injection by a conventional multi-drop system. In this example, a first driving pulse P101 is first supplied, and a first ink liquid pillar K101 is injected from the nozzle. Then, a second driving pulse P102 is supplied, and a second ink liquid pillar K102 is injected from the nozzle. The first ink liquid pillar K101 is divided into an ink drop D101 and a satellite S101. The second ink liquid pillar K102 is also divided into an ink drop D102 and a satellite S102. Then, the ink drop D102 collides against the satellite S101 to form an ink drop D103 larger than the ink drop D102 while being decelerated. The ink drop D101 and the ink drop D103 land on the recording medium and form an ink dot larger than the ink dot formed only by the ink drop D101.

However, the above-described conventional technology has the following problems. First, there is a case where the track of the first ink liquid pillar K101 and the track of the second ink liquid pillar K102 do not match each other due to, for example, the influence of the movement of the air between the nozzle and the recording medium or the influence of the vibration of an inkjet head during scanning. In this case, as shown in FIG. 10, the ink drop D102 does not collide against the satellite S101, and as a result, the ink drop D101 and the ink drop D102 land at different positions. This decreases the image quality. Second, the amount of ink in the satellite S102 generated from the second ink liquid pillar K102 tends to be relatively large, and there is a case where the satellite S102 decreases the image quality. Such problems occur with any other liquid injection device as well as with an inkjet head of an inkjet printer.

SUMMARY OF THE INVENTION

Preferred embodiments of the present invention provide a liquid injection device allowing a liquid, injected by an injection operation performed a plurality of times, to land at an accurate position while an amount of satellite is prevented from being excessively large, and also provide an inkjet printer including such a liquid injection device.

A liquid injection device according to a preferred embodiment of the present invention includes a case accommodating a pressure chamber storing a liquid; a vibration plate provided in the case, the vibration plate defining a portion of the pressure chamber; an actuator coupled with the vibration plate, the actuator being deformed by an electric signal supplied thereto; a nozzle provided in the case, the nozzle being in communication with the pressure chamber; and a driving circuit supplying, to the actuator, a driving signal including a prior driving pulse and a subsequent driving pulse supplied after the prior driving pulse. Where a speed of a leading tip of a prior liquid pillar injected from the nozzle by the prior driving pulse is V3, a speed of a leading tip of a subsequent liquid pillar injected from the nozzle by the subsequent driving pulse is V4, a time period from start of the injection of the prior liquid pillar until start of the injection of the subsequent liquid pillar is t4*a*, a difference between a time period from the injection of the prior liquid pillar from the nozzle until division of the prior liquid pillar in the case where the prior driving pulse is supplied to the actuator but the subsequent driving pulse is not supplied to the actuator, and the time period t4*a*, is t4*b*, and a time period from a start of the injection of the prior liquid pillar until separation of the prior liquid pillar from the nozzle in a case where the prior driving pulse is supplied to the actuator but the subsequent driving pulse is not supplied to the actuator is t3*a*, relationships $t4a \leq t3a$ and $V4 \geq V3 \times (t4a/t4b+1)$ are satisfied.

Another liquid injection device according to a preferred embodiment of the present invention includes a case accommodating a pressure chamber storing a liquid; a vibration plate provided in the case, the vibration plate defining a portion of the pressure chamber; an actuator coupled with the vibration plate, the actuator being deformed by an electric signal supplied thereto; a nozzle provided in the case, the nozzle being in communication with the pressure chamber; and a driving circuit supplying, to the actuator, a driving signal including a prior driving pulse and a subsequent driving pulse supplied after the prior driving pulse. The driving signal is set such that before a prior liquid pillar injected from the nozzle by the prior driving pulse is separated from the nozzle, a subsequent liquid pillar is injected from the nozzle by the subsequent driving pulse; and before the prior liquid pillar is divided, a leading tip of the subsequent liquid pillar catches up with a leading tip of the prior liquid pillar.

Preferred embodiments of the present invention provide a liquid injection device allowing a liquid, injected by an injection operation performed a plurality of times, to land at an accurate position while an amount of satellite is prevented from being excessively large, and also provides an inkjet printer including such a liquid injection device.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Hereinafter, liquid injection devices and inkjet printers including the same according to preferred embodiments of the present invention will be described with reference to the drawings. The preferred embodiments described herein do not limit the present invention in any way. Components or portions having the same functions will bear the same reference signs, and overlapping descriptions will be omitted or simplified.

Figure 1:
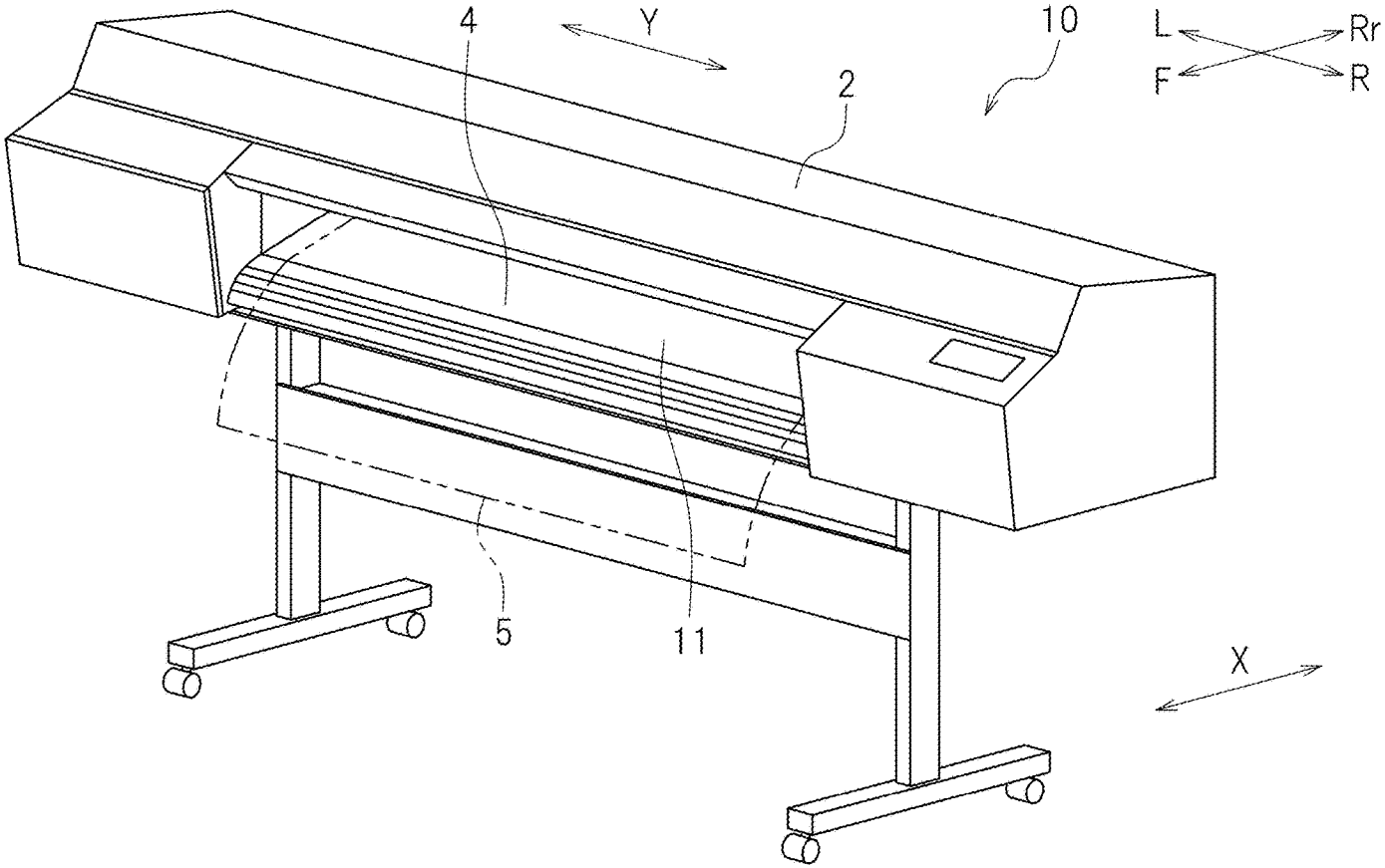
FIG. 1 is a perspective view of an inkjet printer.
Figure 2:
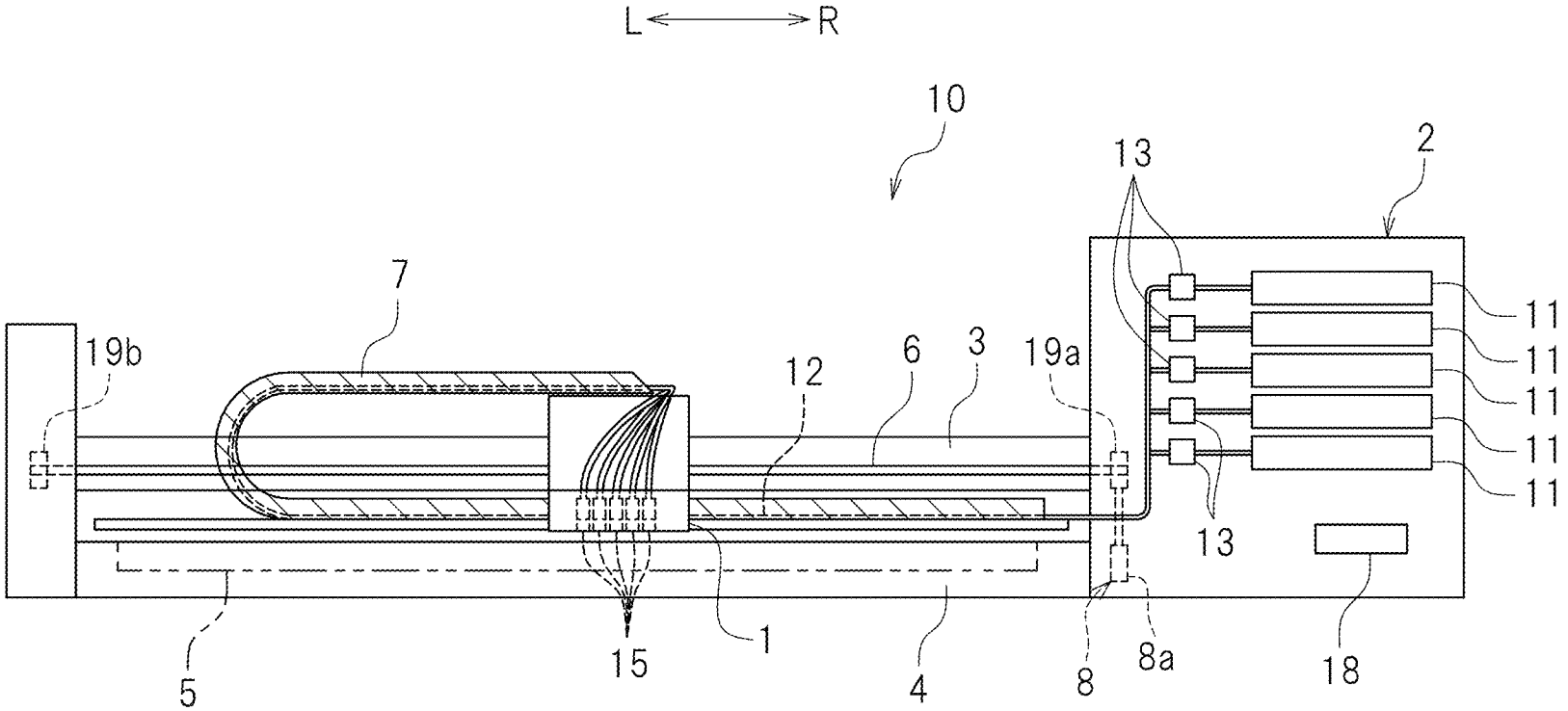
FIG. 2 is a front view of a portion of the inkjet printer.

FIG. 1 is a perspective view of an inkjet printer 10 according to a preferred embodiment of the present invention. FIG. 2 is a front view showing a portion of the inkjet printer 10. In FIG. 1 and FIG. 2, the letters "L" and "R" respectively refer to left and right. The letters "F" and "Rr" respectively refer to front and rear. It should be noted that these directions are defined merely for the sake of convenience, and do not limit the manner of installation of the inkjet printer 10 in any way.

The inkjet printer 10 is to perform printing on a recording paper sheet 5. The recording paper sheet 5 is an example of recording medium, and is an example of target on which ink is to be injected. The "recording medium" encompasses recording mediums formed of paper including plain paper and the like, resin materials including polyvinyl chloride (PVC), polyester and the like, and various other materials including aluminum, iron, wood and the like.

The inkjet printer 10 includes a casing 2, and a guide rail 3 located in the casing 2. The guide rail 3 extends in a left-right direction. The guide rail 3 is in engagement with a carriage 1 provided with injection heads 15 injecting ink. The carriage 1 moves reciprocally in the left-right direction (scanning direction) along the guide rail 3 by a carriage moving mechanism 8. The carriage moving mechanism 8 includes pulleys 19*a* and 19*b* provided at a right end and a left end of the guide rail 3. The pulley 19*a* is coupled with a carriage motor 8*a*. The carriage motor 8*a* may be coupled with the pulley 19*b*. The pulley 19*a* is driven to rotate by the carriage motor 8*a*. An endless belt 6 extends along, and between, the pulleys 19*a* and 19*b*. The endless belt 6 is engaged with the pulleys 19*a* and 19*b*. The carriage 1 is secured to the endless belt 6. When the pulleys 19*a* and 19*b* are rotated and thus the belt 6 runs, the carriage 1 moves in the left-right direction.

The inkjet printer 10 preferably is a large inkjet printer, and is larger than, for example, a table-top printer for home use, for example. The scanning speed of the carriage 1 may preferably be occasionally set to be relatively high from the point of view of increasing the throughput although the scanning speed is set also in consideration of resolution. For example, the scanning speed may be preferably set to about 600 mm/s to about 900 mm/s while the driving frequency may be preferably about 14 kHz. For higher-speed operation, for example, the scanning speed may be set to about 1000 mm/s or greater, for example, about 1100 mm/s to about 1200 mm/s while the driving frequency may be preferably about 20 kHz. The above-described scanning speed and driving frequency are merely examples, and the scanning speed and the driving frequency are not limited to any specific value.

The recording paper sheet 5 is fed in a paper feeding direction by a paper feeding mechanism (not shown). In this example, the paper feeding direction is a front-rear direction. The casing 2 accommodates a platen 4 supporting the recording paper sheet 5. The platen 4 includes a grit roller (not shown). A pinch roller (not shown) is provided above the grit roller. The grit roller is coupled with a feed motor (not shown). The grit roller is driven to rotate by the feed motor. When the grit roller is rotated in a state where the recording paper sheet 5 is held between the grit roller and the pinch roller, the recording paper sheet 5 is fed in the front-rear direction.

The inkjet printer 10 includes a plurality of ink cartridges 11. The plurality of ink cartridges 11 respectively store ink of different colors. For example, the inkjet printer 10 includes five ink cartridges 11 storing cyan ink, magenta ink, yellow ink, black ink and white ink.

The injection heads 15 are respectively provided for the ink of different colors. The injection head 15 and the ink cartridge 11 for each of the different colors are connected with each other via an ink supply path 12. The ink supply path 12 is an ink flow path usable to supply the ink from the ink cartridge 11 to the injection head 15. The ink supply path 12 is, for example, a flexible tube. A pump 13 is provided on the ink supply path 12. The pump 13 is not absolutely necessary, and may be omitted. A portion of the ink supply path 12 is covered with a cable protection and guide device 7.

The injection head 15 injects the ink toward the recording paper sheet 5 to form an ink dot on the recording paper sheet 5. A great number of such dots are arrayed to form an image or the like. The injection head 15 includes a plurality of nozzles 25 (see FIG. 3), from which ink is injected, on a surface thereof that faces the recording paper sheet 5 (in this preferred embodiment, on a bottom surface of the injection head 15).

Figure 3:
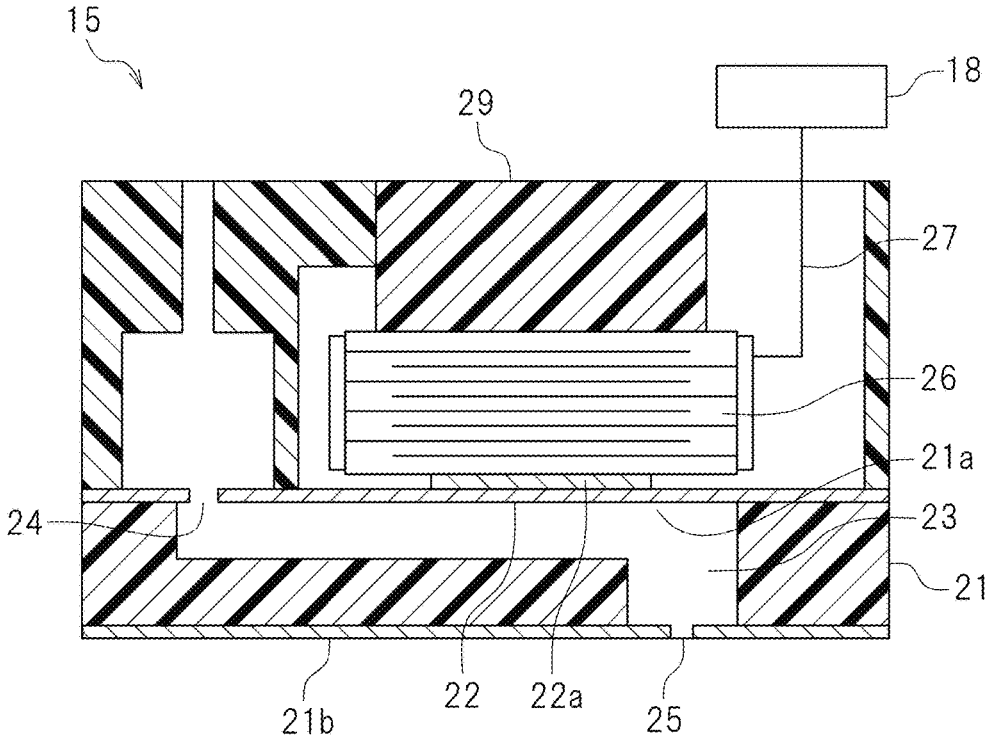
FIG. 3 is a cross-sectional view of an injection head.

FIG. 3 is a partial cross-sectional view of one nozzle 25 and the vicinity thereof of the injection head 15. As shown in FIG. 3, the injection head 15 includes a hollow case 21 provided with an opening 21*a*, and a vibration plate 22 attached to the case 21 so as to cover the opening 21*a*. The vibration plate 22 defines, together with the case 21, a portion of a pressure chamber 23 storing the ink. The vibration plate 22 demarcates a portion of the pressure chamber 23. The vibration plate 22 is elastically deformable to the inside and the outside of the pressure chamber 23. The vibration plate 22 is deformable to increase or decrease the capacity of the pressure chamber 23. The vibration plate 22 is typically a resin film or a metal foil.

The case 21 is provided with an ink inlet 24. The ink inlet 24 allows the ink to flow into the case 21. The ink inlet 24 merely needs to be in communication with the pressure chamber 23, and there is no limitation on the position of the ink inlet 24. The pressure chamber 23 is supplied with the ink from the ink cartridge 11 via the ink inlet 24, and stores the ink. The nozzles 25 are preferably located in a bottom surface 21*b* of the case 21.

A piezoelectric element 26 is coupled with a surface of the vibration plate 22 that is opposite to the pressure chamber 23. The term "coupled" refers to a case where the vibration plate 22 and the piezoelectric element 26 are directly connected with each other and also a case where the vibration plate 22 and the piezoelectric element 26 are indirectly connected with each other via another member. The piezoelectric element 26 may or may not be in contact with the vibration plate 22. In this preferred embodiment, an elastic film 22*a* is provided between the vibration plate 22 and the piezoelectric element 26. A portion of the piezoelectric element 26 is secured to a secured member 29. The piezoelectric element 26 is an actuator. The piezoelectric element 26 is connected with a controller 18 via a flexible cable 27. The piezoelectric element 26 is supplied with a signal via the flexible cable 27. In this preferred embodiment, the piezoelectric element 26 is a stack body including a piezoelectric material layer and a conductive layer stacked alternately. The piezoelectric element 26 is extended or contracted upon receipt of the signal supplied from the controller 18 to act to elastically deform the vibration plate 22 to the inside or to the outside of the pressure chamber 23. In this example, the piezoelectric element 26 is a piezoelectric transducer (PZT) that operates in a longitudinal vibration mode. The PZT of the longitudinal vibration mode is extendable in the stacking direction, and, for example, is contracted when being discharged and is extended when being charged. There is no specific limitation on the type of the piezoelectric element 26.

In the injection head 15 with the above-described structure, the piezoelectric element 26 is contracted by, for example, a decrease in the potential thereof from a reference level. When this occurs, the vibration plate 22 follows this contraction to be elastically deformed to the outside of the pressure chamber 23 from an initial position, and thus the pressure chamber 23 is expanded. The expression that the "pressure chamber 23 is expanded" indicates that the capacity of the pressure chamber 23 is increased by the deformation of the vibration plate 22. Next, the potential of the piezoelectric element 26 is increased to extend the piezoelectric element 26 in the stacking direction. As a result, the vibration plate 22 is elastically deformed to the inside of the pressure chamber 23, and thus the pressure chamber 23 is contracted. The expression that the "pressure chamber 23 is contracted" indicates that the capacity of the pressure chamber 23 is decreased by the deformation of the vibration plate 22. Such expansion/contraction of the pressure chamber 23 changes the pressure inside the pressure chamber 23. Such a change in the pressure inside the pressure chamber 23 pressurizes the ink in the pressure chamber 23, and the ink is injected from the nozzle 25. Then, the potential of the piezoelectric element 26 is returned to the reference level, so that the vibration plate 22 returns to the initial position and the pressure chamber 23 is expanded. At this point, the ink flows into the pressure chamber 23 via the ink inlet 24.

The controller 18 is communicably connected with the carriage motor 8*a* of the carriage moving mechanism 8, the feed motor of the paper feeding mechanism, the pump 13, and the injection head 15. The controller 18 is configured and/or programmed to control operations of these components. The controller 18 is typically a computer. The controller 18 includes, for example, an interface (I/F) receiving printing data or the like from an external device such as a host computer or the like, a central processing unit (CPU) executing a command of a control program, a ROM storing the program to be executed by the CPU, a RAM usable as a working area in which the program is developed, and a storage device such as a memory or the like storing the above-described program and various other types of data.

Figure 4:
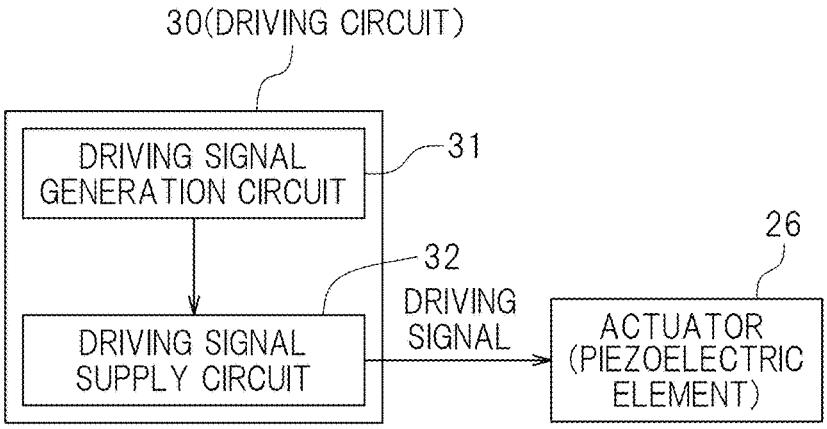
FIG. 4 is a block diagram of a driving circuit and an actuator.

As shown in FIG. 4, the controller 18 includes a driving circuit 30. The driving circuit 30 includes a driving signal generation circuit 31 generating a driving signal, and a driving signal supply circuit 32 supplying a portion of, or the entirety of, the driving signal generated by the driving signal generation circuit 31 to the piezoelectric elements 26 of each of the injection heads 15. In the following description, the piezoelectric element 26 of each injection head 15 will be referred to as an "actuator 26".

There is no limitation on the hardware configuration of the driving signal generation circuit 31 or the driving signal supply circuit 32. The driving signal generation circuit 31 and the driving signal supply circuit 32 may each have a well-known hardware configuration, which will not be described herein.

As described below, a driving signal generated by the driving signal generation circuit 31 includes a plurality of driving pulses. The driving signal supply circuit 32 selects one driving pulse, or two or more driving pulses, from the plurality of driving pulses, and supplies such a driving pulse(s) to the actuators 26. An appropriate selection of the driving pulse(s) to be supplied to the actuators 26 changes the amount of the ink to be injected from the nozzles 25 of the injection head 15 during one driving cycle. This may change the size of each of dots (diameter of each of the dots) formed on the recording paper sheet 5, and also may change the concentration and the landing position of each of the dots. The inkjet printer 10 in this preferred embodiment may form three types of dots having different sizes, for example. In the following description, these three types of dots will be referred to as a "large dot", a "medium dot" and a "small dot" in the order from the largest dot.

Figure 5:
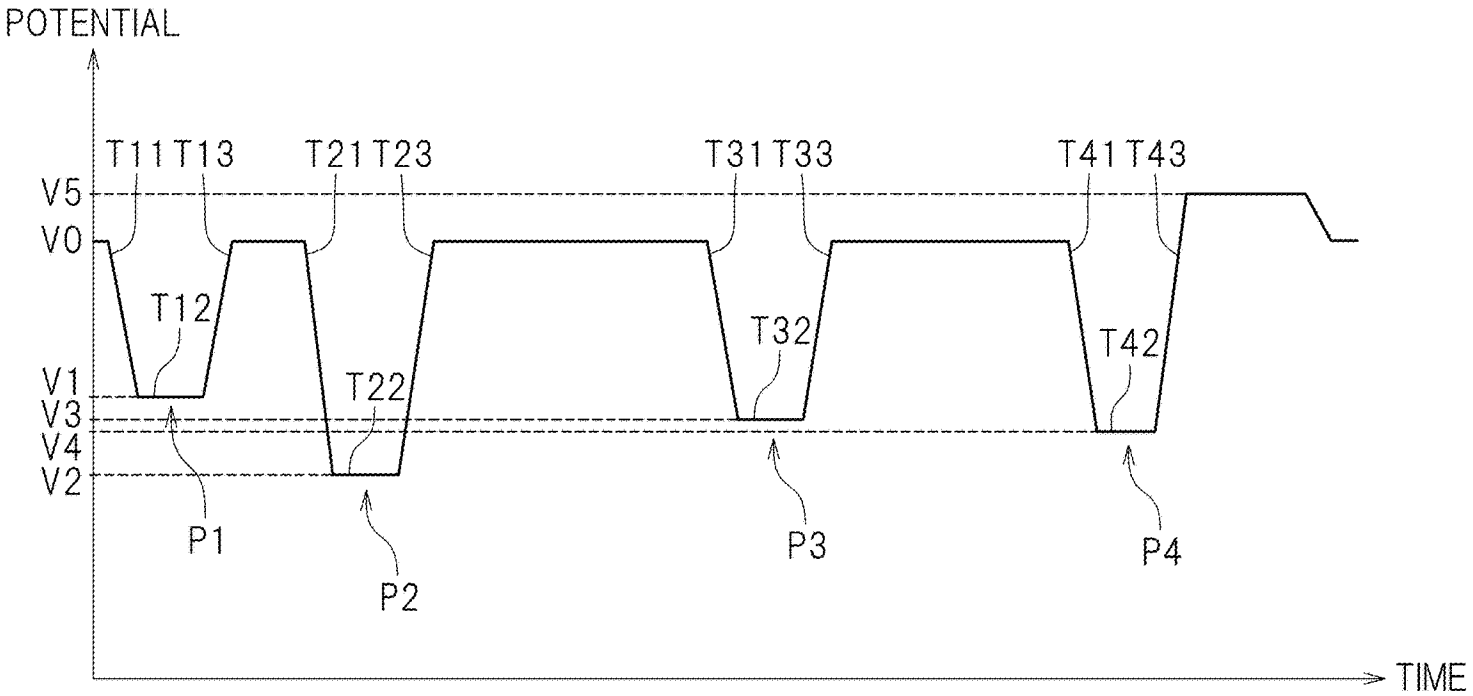
FIG. 5 is a waveform diagram of a driving signal generated by a driving signal generation circuit.

FIG. 5 is a waveform diagram showing a driving signal generated by the driving signal generation circuit 31. FIG. 5 shows a waveform of one driving cycle. The horizontal axis represents the time, and the vertical axis represents the potential. The driving signal generation circuit 31 is configured and/or programmed to generate the driving signal as shown in FIG. 5 at every driving cycle in repetition.

The driving signal includes first through fourth driving pulses P1 through P4. The driving signal may include a driving pulse other than the first through fourth driving pulses P1 through P4. A "driving pulse" is a waveform including a waveform component by which the potential is decreased, a waveform component by which the decreased potential is maintained at the decreased level, and a waveform component by which the maintained potential is increased; or is a waveform including a waveform component by which the potential is increased, a waveform component by which the increased potential is maintained at the increased level, and a waveform component by which the maintained potential is decreased.

The first driving pulse P1 includes a discharge waveform component T11 by which the potential is decreased from reference potential V0 to V1, a discharge maintaining waveform component T12 by which the potential is maintained at V1, and a charge waveform component T13 by which the potential is increased from V1 to V0. The second driving pulse P2 includes a discharge waveform component T21 by which the potential is decreased from V0 to V2, a discharge maintaining waveform component T22 by which the potential is maintained at V2, and a charge waveform component T23 by which the potential is increased from V2 to V0. The third driving pulse P3 includes a discharge waveform component T31 by which the potential is decreased from V0 to V3, a discharge maintaining waveform component T32 by which the potential is maintained at V3, and a charge waveform component T33 by which the potential is increased from V3 to V0. The fourth driving pulse P4 includes a discharge waveform component T41 by which the potential is decreased from V0 to V4, a discharge maintaining waveform component T42 by which the potential is maintained at V4, and a charge waveform component T43 by which the potential is increased from V4 to V5. The first through fourth driving pulses P1 through P4 are driving pulses that once increase the capacity of the pressure chamber 43 and then decrease the capacity of the pressure chamber 43 to the original capacity or to a capacity smaller than the original capacity. Alternatively, the first through fourth driving pulses P1 through P4 may be driving pulses that once increase the capacity of the pressure chamber 43 and then decrease the capacity of the pressure chamber 43 to a capacity larger than the original capacity. In other words, the first through fourth driving pulses P1 through P4 are driving pulses that once depressurize and then pressurize the pressure chamber 23. There is no specific limitation on the degree of pressurization after the depressurization. The pressure of the pressure chamber 23 after the pressurization may be smaller, larger or equal to the pressure thereof before the depressurization.

In order to form a small dot, the driving signal supply circuit 32 supplies the second driving pulse P2, but does not supply any of the first driving pulse P1, the third driving pulse P3 and the fourth driving pulse P4, to the actuator 26. With such an arrangement, the capacity of the pressure chamber 23 is once increased and then is decreased, and an operation of injecting the ink from the nozzle 25 is performed once. As a result, a first liquid amount of ink is injected from the nozzle 25, and thus a small dot is formed on the recording paper sheet 5.

In order to form a medium dot, the driving signal supply circuit 32 supplies the third driving pulse P3 and the fourth driving pulse P4, but does not supply either of the first driving pulse P1 and the second driving pulse P2, to the actuator 26. The third driving pulse P3 is an example of a "prior driving pulse", and the fourth driving pulse P4 is an example of a "subsequent driving pulse". When the third driving pulse P3 is supplied to the actuator 26, the capacity of the pressure chamber is once increased and then is decreased, and an operation of injecting the ink from the nozzle 25 is performed once. When the fourth driving pulse P4 is then supplied to the actuator 26, the capacity of the pressure chamber is, again, once increased and then is decreased, and an operation of injecting the ink from the nozzle 25 is further performed once. As can be seen, when the third driving pulse P3 and the fourth driving pulse P4 are supplied to the actuator 26 in this manner, an operation of injecting the ink from the nozzle 25 is performed twice in total. As a result, a second liquid amount of ink, which is larger than the first liquid amount of ink, is injected from the nozzle 25, and thus a medium dot is formed on the recording paper sheet 5.

In order to form a large dot, the driving signal supply circuit 32 supplies the first through fourth driving pulses P1 through P4 to the actuator 26. When the first driving pulse P1 and the second driving pulse P2 are supplied to the actuator 26, an operation of injecting the ink from the nozzle 25 is performed twice in total. When the third driving pulse P3 and the fourth driving pulse P4 are then supplied to the actuator 26, an operation of injecting the ink from the nozzle 25 is further performed twice in total. As can be seen, when the first through fourth driving pulses P1 through P4 are supplied to the actuator 26 in this manner, an operation of injecting the ink from the nozzle 25 is performed four times in total. As a result, a third liquid amount of ink, which is larger than the second liquid amount of ink, is injected from the nozzle 25, and thus a large dot is formed on the recording paper sheet 5.

Figure 6:
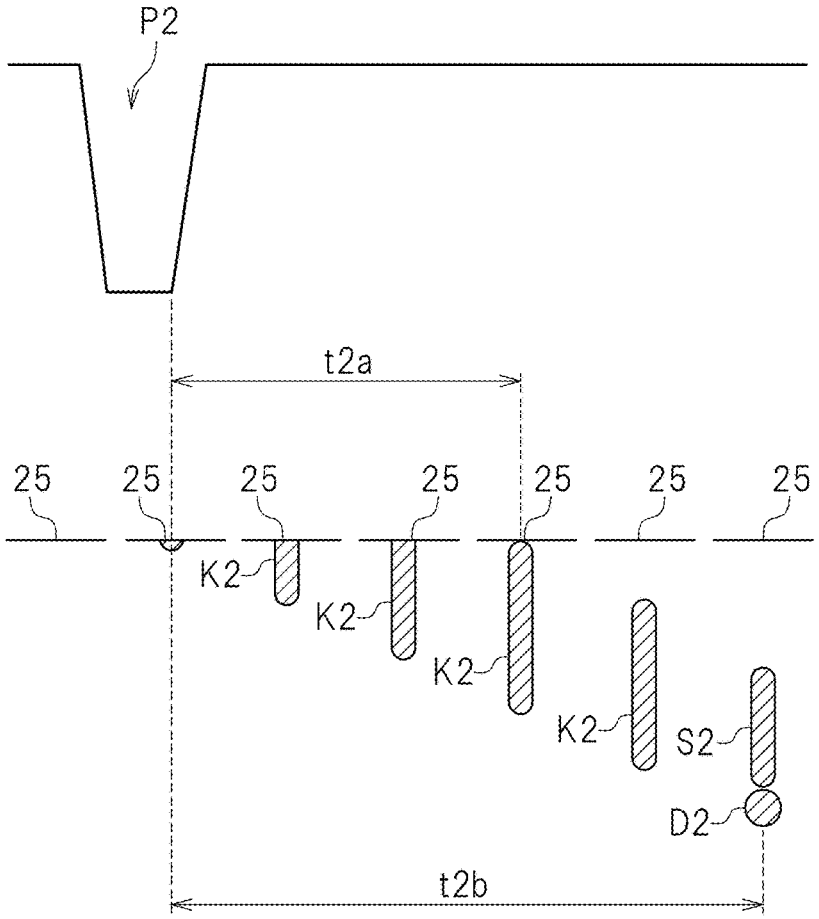
FIG. 6 shows a driving signal and a behavior of ink when a small dot is to be formed.

Now, a behavior of ink made in order to form a small dot will be described. As shown in FIG. 6, in order to form a small dot, the second driving pulse P2 is supplied to the actuator 26. As a result, an ink liquid pillar K2 is injected from the nozzle 25. In FIG. 6, ink is hatched. The ink liquid pillar K2 is separated from the nozzle 25 when a time period t2*a* lapses after the start of the injection. Then, the ink liquid pillar K2 is divided when a time period t2*b* lapses after the start of the injection. For example, the ink liquid pillar K2 is divided into an ink drop D2 and a satellite S2.

Figure 7:
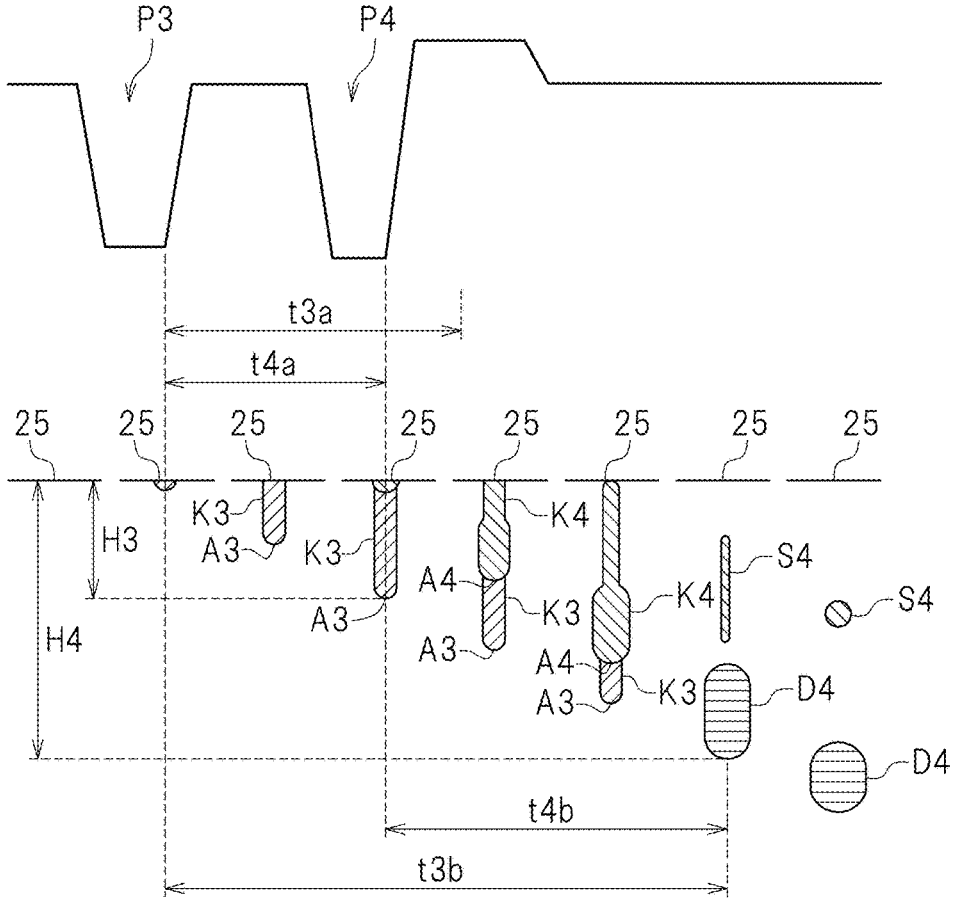
FIG. 7 shows a driving signal and a behavior of ink when a medium dot is to be formed.

In order to form a medium dot, the third driving pulse P3 and the fourth driving pulse P4 are supplied to the actuator 26. As shown in FIG. 7, when the third driving pulse P3 is supplied to the actuator 26, an ink liquid pillar K3 is injected from the nozzle 25. When the fourth driving pulse P4 is supplied to the actuator 26, an ink liquid pillar K4 is injected from the nozzle 25 before the ink liquid pillar K3 is separated from the nozzle 25. In FIG. 7, the ink liquid pillar K3 and the ink liquid pillar K4 are hatched in different manners in order to be easily distinguishable from each other. The ink liquid pillar K3 is an example of "prior liquid pillar", and the ink liquid pillar K4 is an example of "subsequent liquid pillar". The third driving pulse P3 and the fourth driving pulse P4 are set such that before the ink liquid pillar K3 is divided, a leading tip A4 of the ink liquid pillar K4 catches up with a leading tip A3 of the ink liquid pillar K3. A majority of the ink liquid pillar K4 is combined with the ink liquid pillar K3 to form an ink drop D4, which is larger than the ink drop D2 (see FIG. 6). The remaining portion of the ink liquid pillar K4 becomes a satellite S4.

Herein, a time period from the start of the injection of the ink liquid pillar K3 until the start of the injection of the ink liquid pillar K4 is set as t4*a*. A time period from the injection of the ink liquid pillar K3 until the separation of the ink liquid pillar K3 from the nozzle 25 in the case where the third driving pulse P3 is supplied, but the fourth driving pulse P4 is not supplied, to the actuator 26 is set as t3*a*. The ink liquid pillar K4 is injected before the ink liquid pillar K3 is separated from the nozzle 25 under the condition of t4*a* t3*a*.

A speed of the leading tip A3 of the ink liquid pillar K3 is set as V3, and a speed of the leading tip A4 of the ink liquid pillar K4 is set as V4. A time period from the injection until the division of the ink liquid pillar K3 in the case where the third driving pulse P3 is supplied but the fourth driving pulse P4 is not supplied is set as t3*b*. A difference between the time period t3*b*, and the time period t4*a* from the start of the injection of the ink liquid pillar K3 until the start of the injection of the ink liquid pillar K4, is set as t4*b*. A distance between the nozzle 25 and the leading tip A3 of the ink liquid pillar K3 is set as H3, and a distance between the nozzle 25 and the leading tip A4 of the ink liquid pillar A4 is H4. Now, it is assumed that the leading tip A4 of the ink liquid pillar K4 catches up with the leading tip A3 of the ink liquid pillar K3 immediately before the ink liquid pillar K3 is divided. In this case, the distance H3 between the nozzle 25 and the leading tip A3 of the ink liquid pillar K3 is H3=V3×(t4*a*+t4*b*), and the distance H4 between the nozzle 25 and the leading tip A4 of the ink liquid pillar K4 is H4=V4×t4*b*. In the case where H3=H4, V3×(t4*a*+t4*b*)=V4×t4*b*. Therefore, V4=V3×(t4*a*/t4*b*+1). Hence, it is considered that when V4≥V3×(t4*a*/t4*b*+1), the leading tip A4 of the ink liquid pillar K4 catches up with the leading tip A3 of the ink liquid pillar K3 before the ink liquid pillar K3 is divided.

For the above-described reason, in this preferred embodiment, the third driving pulse P3 and the fourth driving pulse P4 are set to satisfy the following conditions:

$$t4a \leq t3a$$

$$V4 \geq V3 \times (t4a/t4b+1).$$

In this preferred embodiment, after the leading tip A4 of the ink liquid pillar K4 catches up with the leading tip A3 of the ink liquid pillar K3, the ink drop D4 formed as a result of the merging of the ink liquid pillar K3 and a portion of the ink liquid pillar K4 lands on the recording paper sheet 5. Therefore, the distance between the nozzle 25 and the recording paper sheet is set to be longer than, or equal to, H4 (=V4×t4*b*).

Figure 8:
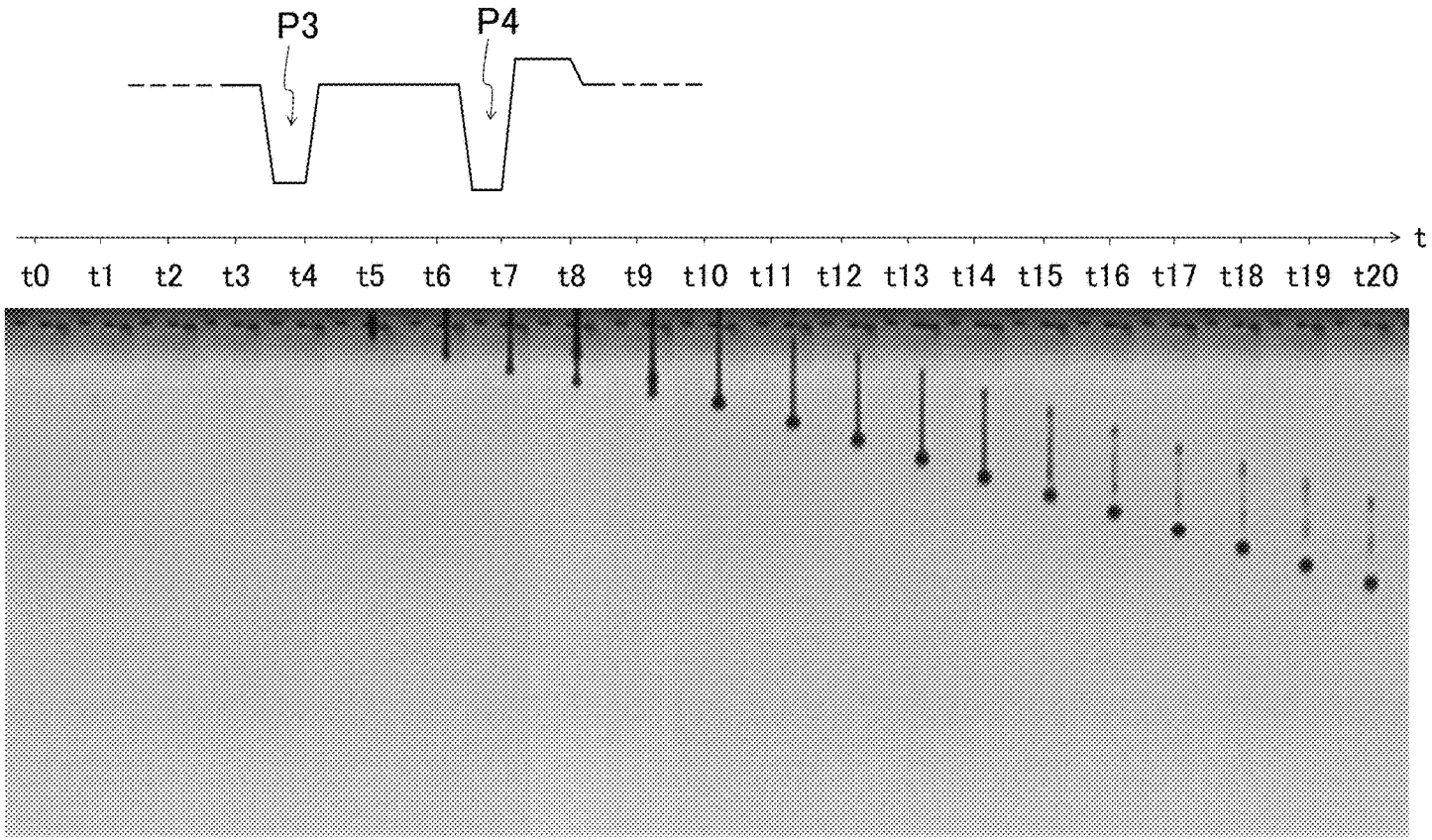
FIG. 8 shows a captured image showing an example of behavior of ink when a medium dot is to be formed.
Figure 9:
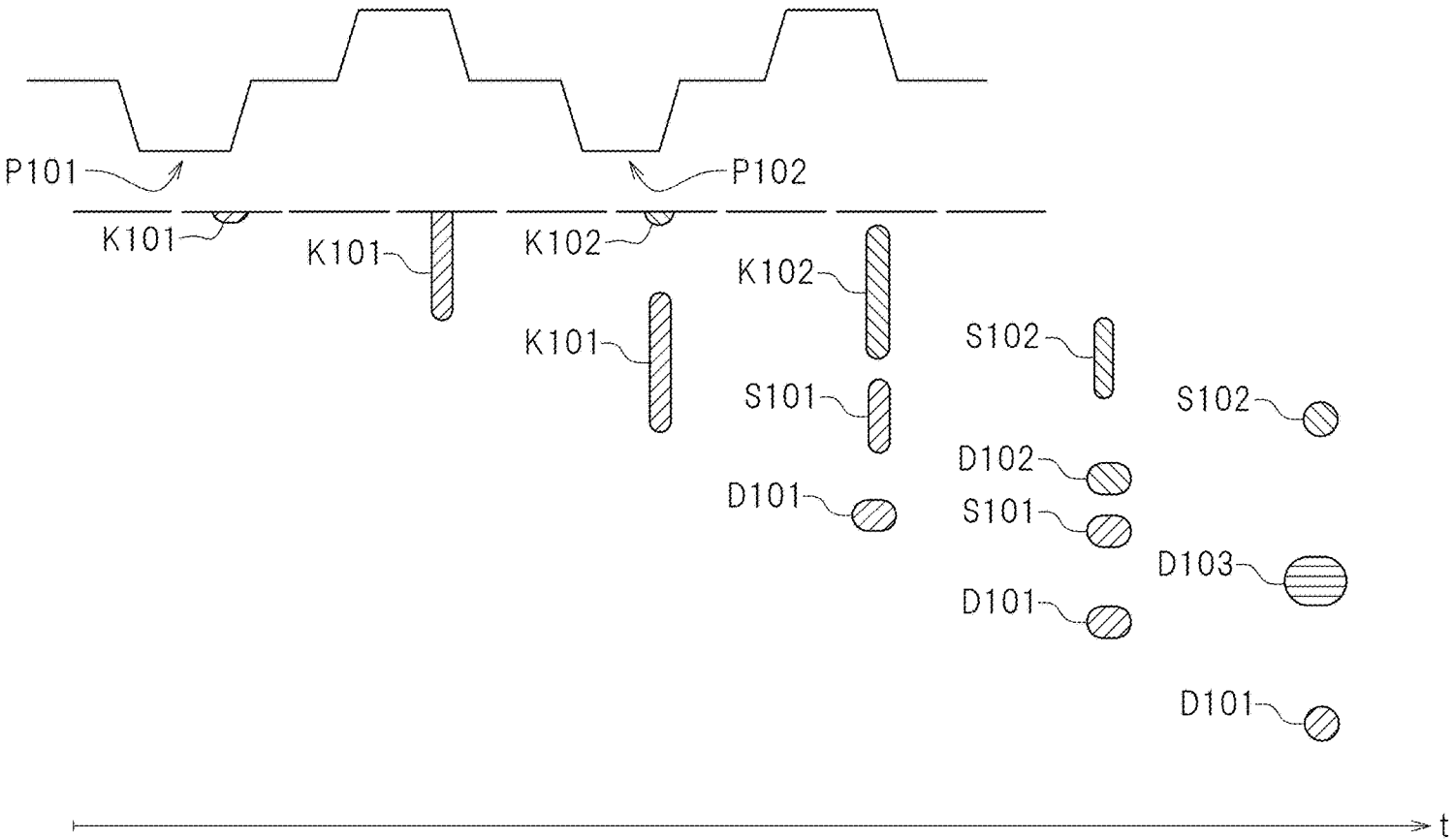
FIG. 9 PRIOR ART
FIG. 9 shows a driving signal and a behavior of ink in an example of liquid injection by a conventional multi-drop system.
Figure 10:
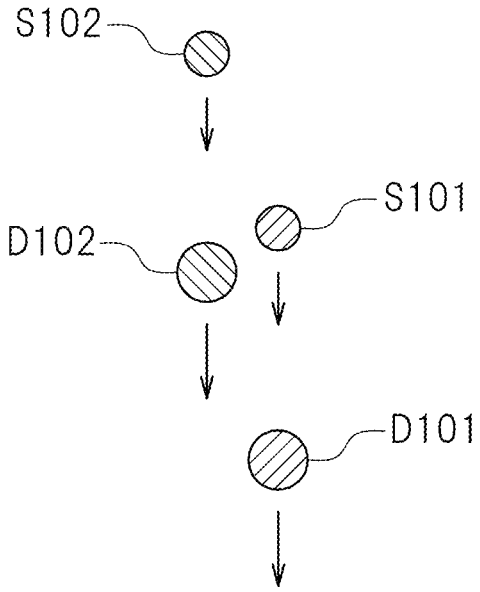
FIG. 10 PRIOR ART
FIG. 10 shows a behavior of ink when a track of a first ink liquid pillar and a track of a second ink liquid pillar do not match each other.

FIG. 8 shows a captured image showing an example of behavior of ink when the third driving pulse P3 and the fourth driving pulse P4 are supplied. In FIG. 8, t1 through t20 represent time passage. It is seen from FIG. 8 that the ink liquid pillar K3 is injected from the nozzle 25 at or around t4 and that the ink liquid pillar K4 is injected from the nozzle at or around t7. It is also seen from FIG. 8 that the leading tip A4 of the ink liquid pillar K4 catches up with the leading tip A3 of the ink liquid pillar K3 at t9 to t10 and that the ink liquid pillar K4 is divided at t14 to t15, so that the ink drop D4 is formed as a result of the merging of the ink liquid pillar K3 and a majority of the ink liquid pillar K4 and the satellite S4 is formed of the remaining portion of the ink liquid pillar K4.

In order to form a large dot, the first driving pulse P1 and the second driving pulse P2 are supplied to the actuator 26, and then the third driving pulse P3 and the fourth driving pulse P4 are supplied to the actuator 26. In this preferred embodiment, the first driving pulse P1 and the second driving pulse P2 preferably are set in the same or substantially the same manner as the third driving pulse P3 and the fourth driving pulse P4. Specifically, the first driving pulse P1 and the second driving pulse P2 are set such that before an ink liquid pillar injected from the nozzle 25 by the first driving pulse P1 (hereinafter, such an ink liquid pillar will be referred to as a "first ink liquid pillar") is separated from the nozzle 25, an ink liquid pillar starts to be injected from the nozzle 25 by the second driving pulse P2 (such an ink liquid pillar will be referred to as a "second ink liquid pillar"). The first driving pulse P1 and the second driving pulse P2 are set such that before the first ink liquid pillar is divided, a leading tip of the second ink liquid pillar catches up with a leading tip of the first ink liquid pillar. Herein, the first driving pulse P1 and the second driving pulse P2 are set to satisfy the following conditions:

$$t2a \leq t1a$$

$$V2 \geq V1 \times (t2a/t2b+1).$$

V1 is a speed of the leading tip of the first ink liquid pillar, and V2 is a speed of the leading tip of the second ink liquid pillar. t1*a* is a time period from the injection of the first ink liquid pillar until the separation of the first ink liquid pillar from the nozzle 25 in the case where the first driving pulse P1 is supplied but the second driving pulse P2 is not supplied. t2*a* is a time period from the start of the injection of the first ink liquid pillar until the start of the injection of the second ink liquid pillar. t2*b* is a difference between a time period from the injection of the first ink liquid pillar from the nozzle 25 until the division of the first ink liquid pillar in the case where the first driving pulse P1 is supplied but the second driving pulse P2 is not supplied, and the time period t2*a*. The distance between the nozzle 25 and the recording paper sheet 5 is set to longer than, or equal to, V2×t2*b*.

As described above, in the inkjet printer 10 in this preferred embodiment, in order to form a medium dot, the third driving pulse P3 and the fourth driving pulse P4 are supplied to the actuator 26. The third driving pulse P3 and the fourth driving pulse P4 are set such that before the ink liquid pillar K3 injected from the nozzle 25 by the third driving pulse P3 is separated from the nozzle 25, the ink liquid pillar K4 is injected from the nozzle 25 by the fourth driving pulse P4. If the ink liquid pillar K3 is separated from the nozzle 25 before the ink liquid pillar K4 is injected, a track of the ink liquid pillar K3 and a track of the ink liquid pillar K4 may be deviated from each other due to, for example, the influence of the movement of the air between the nozzle 25 and the recording paper sheet 5 or the influence of the vibration of the injection head 15 during scanning. However, in this preferred embodiment, the ink liquid pillar K4 is injected before the ink liquid pillar K3 is separated from the nozzle 25. Therefore, the ink liquid pillar K3 and the ink liquid pillar K4 advance toward the recording paper sheet 5 in an integral state (see FIG. 7). The ink liquid pillar K3 acts as a guide, so that the ink liquid pillar K4 moves in the ink liquid pillar K3. Therefore, the track of the ink liquid pillar K3 and the track of the ink liquid pillar K4 are prevented from being deviated from each other.

In the inkjet printer 10 in this preferred embodiment, the third driving pulse P3 and the fourth driving pulse P4 are set such that the leading tip A4 of the ink liquid pillar K4 catches up with the leading tip A3 of the ink liquid pillar K3 within the time period tab (see FIG. 7) from the injection until the division of the ink liquid pillar K3 in the case where the fourth driving pulse P4 is not supplied after the third driving pulse P3 is supplied. When the ink liquid pillar K3 is divided into an ink drop and a satellite, a leading tip of the satellite is supplied with a force acting in a direction opposite to the advancing direction by surface tension. The leading tip of the satellite is supplied with a force acting in a direction opposite to the advancing direction, so that the satellite, which is pillar-shaped, becomes spherical. Therefore, if the ink liquid pillar K3 is divided before the leading tip A4 of the ink liquid pillar K4 catches up with the leading tip A3 of the ink liquid pillar K3, the leading tip A4 of the ink liquid pillar K4 is supplied with a force acting in a direction opposite to the advancing direction. As a result, the speed of the leading tip A4 of the ink liquid pillar K4 is decreased, and it is made difficult to merge the ink liquid pillar K4 with the ink drop ahead thereof in a good manner before the ink drop lands on the recording paper sheet 5. In this case, it is difficult to form an ink drop of a liquid amount sufficient to form a medium dot. However, in this preferred embodiment, the leading tip A4 of the ink liquid pillar K4 catches up with the leading tip A3 of the ink liquid pillar K3 before the ink liquid pillar K3 is divided. Therefore, the ink liquid pillar K3 is not divided, and the ink liquid pillar K3 and the ink liquid pillar K4 form the ink drop D4 (see FIG. 7) of a liquid amount sufficient to form a medium dot. The ink drop D4 with a sufficient liquid amount forms a good medium dot on the recording paper sheet 5. Since the leading tip A4 of the ink liquid pillar K4 catches up with the leading tip A3 of the ink liquid pillar K3, the speed of the leading tip A4 of the ink liquid pillar K4 is decreased. Therefore, the speed of the ink drop D4 when the satellite S4 is divided from the ink liquid pillar K4 is made low. As a result, the liquid amount of the satellite S4 is prevented from being excessively large, and the decrease in the image quality caused by the satellite S4 is prevented.

As described above, in this preferred embodiment, the track of the ink liquid pillar K3 and the track of the ink liquid pillar K4 are prevented from being deviated from each other, the ink drop D4 having a sufficient liquid amount is formed, and the liquid amount of the satellite S4 is prevented from being excessively large. Therefore, the ink drop for a medium dot is injected correctly and stably. While the liquid amount of the satellite S4 is prevented from being excessively large, the ink drop D4 is allowed to land at an accurate position. As a result, a good medium dot is formed on the recording paper sheet 5, and thus high quality printing is performed.

In the inkjet printer 10 in this preferred embodiment, in order to form a large dot, the first through fourth driving pulses P1 through P4 are supplied to the actuator 26. The third driving pulse P3 and the fourth driving pulse P4 are as described above. The first driving pulse P1 and the second driving pulse P2 are set such that before the first ink liquid pillar injected from the nozzle 25 by the first driving pulse P1 is separated from the nozzle 25, the second ink liquid pillar is injected from the nozzle 25 by the second driving pulse P2. The first driving pulse P1 and the second driving pulse P2 are set such that the leading tip of the second ink liquid pillar catches up with the leading tip of the first ink liquid pillar within the time period from the injection until the division of the first ink liquid pillar in the case where the second driving pulse P2 is not supplied after the first driving pulse P1 is supplied. Therefore, the ink drop formed by the first ink liquid pillar and the second ink liquid pillar, and the ink drop formed of the ink liquid pillar K3 and the ink liquid pillar K4, form a good large dot on the recording paper sheet 5. Thus, high quality printing is performed.

Preferred embodiments of the present invention have been described so far. The above-described preferred embodiments are merely examples, and the present invention may be carried out in any of various other preferred embodiments.

In the above-described preferred embodiment, the first driving pulse P1 and the second driving pulse P2 preferably are set the same or substantially the same as the third driving pulse P3 and the fourth driving pulse P4. There is no specific limitation on the settings of the first driving pulse P1 and the second driving pulse P2.

The first through fourth driving pulses P1 through P4 shown in FIG. 5 are merely examples, and there is no specific limitation on the shape or the size of each of the first through fourth driving pulses P1 through P4.

The inkjet printer 10 in the above-described preferred embodiment preferably forms three types of dots different in the size on the recording paper sheet 5, for example. The inkjet printer 10 in the above-described preferred embodiment is preferably capable of forming a small dot, a medium dot and a large dot on the recording paper sheet 5, for example. Alternatively, the inkjet printer 10 may form two types, or four or more types, of dots different in the size on the recording paper sheet 5. For example, the inkjet printer 10 may be capable of forming a small dot and a medium dot on the recording paper sheet 5. In this case, the first driving pulse P1 is not necessary and may be omitted. The inkjet printer 10 may form one size of dots on the recording paper sheet 5. For example, the inkjet printer 10 may be capable of forming only medium dots. In this case, the first driving pulse P1 and the second driving pulse P2 may be omitted.

In the above-described preferred embodiments, the actuator is preferably a longitudinal vibration mode piezoelectric element, for example. The actuator is not limited to this. The actuator may be a transverse vibration mode piezoelectric element. The actuator is not limited to a piezoelectric element, and may be, for example, a magnetostrictive element.

In the above-described preferred embodiments, the liquid is preferably ink, for example. The liquid is not limited to this. The liquid may be, for example, a resin material, any of various liquid compositions containing a solute and a solvent (e.g., washing liquid), or the like.

In the above-described preferred embodiments, the injection head is preferably the injection head 15 mountable on the inkjet printer, for example. The injection head is not limited to this. The injection head may be mountable on, for example, any of various production devices of an inkjet system, a measuring device such as a micropipette, or the like, to be usable in any of various uses.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid ejection device, comprising:

a case accommodating a pressure chamber storing a liquid;

a vibration plate provided in the case, the vibration plate defining a portion of the pressure chamber;

an actuator coupled with the vibration plate, the actuator being deformed by an electric signal supplied thereto;

a nozzle provided in the case, the nozzle being in communication with the pressure chamber; and a driving circuit supplying, to the actuator, a driving signal including a prior driving pulse and a subsequent driving pulse supplied after the prior driving pulse;

wherein a speed of a leading tip of a prior liquid pillar injected from the nozzle by the prior driving pulse is V3; a speed of a leading tip of a subsequent liquid pillar injected from the nozzle by the subsequent driving pulse is V4;

a time period from start of the ejection of the prior liquid pillar until start of the ejection of the subsequent liquid pillar is t4*a;* a difference between a time period from the ejection of the prior liquid pillar from the nozzle until division of the prior liquid pillar in the case where the prior driving pulse is supplied to the actuator but the subsequent driving pulse is not supplied to the actuator, and the time period t4*a*, is t4*b;* a time period from start of the ejection of the prior liquid pillar until separation of the prior liquid pillar from the nozzle in the case where the prior driving pulse is supplied to the actuator but the subsequent driving pulse is not supplied to the actuator is t3*a;*

$$t4a \leq t3a; \text{ and}$$

$$V4 \geq V3(t4a/t4b+1).$$

2. The liquid ejection device according to claim 1, wherein the driving signal includes a first driving pulse supplied before the prior driving pulse and a second driving pulse supplied after the first driving pulse but before the prior driving pulse; and a speed of a leading tip of a first liquid pillar injected from the nozzle by the first driving pulse is V1;

a speed of a leading tip of a second liquid pillar injected from the nozzle by the second driving pulse is V2;

a time period from start of the ejection of the first liquid pillar until start of the ejection of the second liquid pillar is t2*a;* a difference between a time period from the ejection of the first liquid pillar from the nozzle until division of the first liquid pillar in the case where the first driving pulse is supplied to the actuator but the second driving pulse is not supplied to the actuator, and the time period t2*a*, is t2*b;* a time period from start of the ejection of the first liquid pillar until separation of the first liquid pillar from the nozzle in the case where the first driving pulse is supplied to the actuator but the second driving pulse is not supplied to the actuator is t1*a;*

$$t2a \leq t1a; \text{ and}$$

$$V2 \geq V1(t2a/t2b+1).$$

3. The liquid ejection device according to claim 1, wherein the driving signal includes a first driving pulse supplied before the prior driving pulse and a second driving pulse supplied after the first driving pulse but before the prior driving pulse; and the driving signal is set such that:

before the first liquid pillar injected from the nozzle by the first driving pulse is separated from the nozzle, the second liquid pillar is injected from the nozzle by the second driving pulse; and before the first liquid pillar is divided, the leading tip of the second liquid pillar catches up with the leading tip of the first liquid pillar.

4. The liquid ejection device according to claim 1, wherein each of the driving pulses is a pulse decreasing and then increasing a pressure of the liquid in the pressure chamber.

5. An inkjet printer, comprising the liquid ejection device according to claim 1;

wherein the liquid is ink.

6. A liquid ejection device, comprising:

a case accommodating a pressure chamber storing a liquid;

a vibration plate provided in the case, the vibration plate defining a portion of the pressure chamber;

an actuator coupled with the vibration plate, the actuator being deformed by an electric signal supplied thereto;

a nozzle provided in the case, the nozzle being in communication with the pressure chamber; and a driving circuit supplying, to the actuator, a driving signal including a prior driving pulse and a subsequent driving pulse supplied after the prior driving pulse;

wherein the driving signal is set such that: before a prior liquid pillar injected from the nozzle by the prior driving pulse is separated from the nozzle, a subsequent liquid pillar is injected from the nozzle by the subsequent driving pulse; and before the prior liquid pillar is divided, a leading tip of the subsequent liquid pillar catches up with a leading tip of the prior liquid pillar.

7. The liquid ejection device according to claim 6, wherein the driving signal includes a first driving pulse supplied before the prior driving pulse and a second driving pulse supplied after the first driving pulse but before the prior driving pulse;

a speed of a leading tip of a first liquid pillar injected from the nozzle by the first driving pulse is V1;

a speed of a leading tip of a second liquid pillar injected from the nozzle by the second driving pulse is V2;

a time period from start of the ejection of the first liquid pillar until start of the ejection of the second liquid pillar is t2*a;* a difference between a time period from the ejection of the first liquid pillar from the nozzle until division of the first liquid pillar in the case where the first driving pulse is supplied to the actuator but the second driving pulse is not supplied to the actuator, and the time period t2*a*, is t2*b*; and a time period from start of the ejection of the first liquid pillar until separation of the first liquid pillar from the nozzle in the case where the first driving pulse is supplied to the actuator but the second driving pulse is not supplied to the actuator is t1*a;*

$$t2a \leq t1a; \text{ and}$$

$$V2 \geq V1(t2a/t2b+1).$$

8. The liquid ejection device according to claim 6, wherein the driving signal includes a first driving pulse supplied before the prior driving pulse and a second driving pulse supplied after the first driving pulse but before the prior driving pulse; and the driving signal is set such that: before the first liquid pillar injected from the nozzle by the first driving pulse is separated from the nozzle, the second liquid pillar is injected from the nozzle by the second driving pulse; and before the first liquid pillar is divided, the leading tip of the second liquid pillar catches up with the leading tip of the first liquid pillar.

9. The liquid ejection device according to claim 6, wherein each of the driving pulses is a pulse decreasing and then increasing a pressure of the liquid in the pressure chamber.

10. An inkjet printer, comprising the liquid ejection device according to claim 6;

wherein the liquid is ink.

* * * * *